US005497718A

United States Patent [19]

Cash

[11] Patent Number: 5,497,718

[45] Date of Patent: Mar. 12, 1996

[54] AIR OPERATED SYSTEM FOR TAPE EDGE MACHINE IN MATTRESS MANUFACTURING

[75] Inventor: David R. Cash, Louisville, Ky.

[73] Assignee: James Cash Machine Co., Inc., Louisville, Ky.

[21] Appl. No.: 214,407

[22] Filed: Mar. 16, 1994

[51] Int. Cl.[6] ..... D05B 11/00; D05B 69/08

[52] U.S. Cl. ..... 112/2.1; 112/276

[58] Field of Search ..... 112/2, 2.1, 270, 112/271, 220, 258, 259, 276; 74/491, 515, 515 E, 512; 200/86.5, 331, 330, 332

[56] References Cited

U.S. PATENT DOCUMENTS

| | | | |
|---|---|---|---|
| 1,857,371 | 5/1932 | Gail | 112/2.1 |
| 2,127,209 | 8/1938 | Duchan | 74/515 |
| 2,609,768 | 9/1952 | Cash et al. | 112/2.1 |
| 3,083,654 | 4/1963 | Cash, Sr. | 112/2.1 |
| 3,977,339 | 8/1976 | Tice | 112/276 |
| 4,014,273 | 3/1977 | Kosakai | 112/2.1 |
| 4,043,282 | 8/1977 | Fanghanel | 112/2.1 |
| 4,583,474 | 4/1986 | Tysinger | 74/515 E |

FOREIGN PATENT DOCUMENTS

| | | | |
|---|---|---|---|
| 950761 | 7/1974 | Canada | 112/276 |

*Primary Examiner*—C. D. Crowder
*Assistant Examiner*—Ismael Izaguirre
*Attorney, Agent, or Firm*—Middleton & Reutlinger; James C. Eaves, Jr.

[57] ABSTRACT

A compressed air operated ergonomic system used with a tape edge machine carriage employed in mattress manufacturing. The operator's arm, leg, knee, or foot can be used to stop the sewing operation and stop the carriage from moving around the table. The compressed air system can also provide an operator air source, engage the gear mechanisms which permit the carriage to move around the table, provide needle cooling, and permit the sewing machine presser foot to be raised.

14 Claims, 3 Drawing Sheets

AIR OPERATED SYSTEM FOR TAPE EDGE MACHINE IN MATTRESS MANUFACTURING

BACKGROUND OF THE INVENTION (a) Field of the Invention

The present invention relates to a compressed air operated ergonomic system used with a tape edge machine carriage employed in mattress manufacturing. The operator's arm, leg, knee, or foot can be used to stop the sewing operation and stop the carriage from moving around the table.

(b) Description of the Prior Art

Tape edge machines are employed in the mattress making industry. Typically a horizontal adjustable table assembly is provided which receives a mattress to be sewn. At this stage of manufacture, the mattress has its interior components. The vertical border material surrounds the mattress. The mattress top and bottom portions are covered with the appropriate pads and outer material.

The table assembly has a top and a bottom guide track therearound. A carriage assembly is supported by the table assembly at the top guide track. The carriage assembly has a drive gear assembly which can engage the top guide track and move the carriage assembly around the table to fully encircle the mattress to be sewn. The carriage assembly has a roller assembly which rolls along the bottom guide track for carriage stability as the carriage assembly moves around the table. The carriage assembly contains the sewing machine used to sew the mattress edges.

In operation, the operator activates the drive gear assembly of the carriage assembly and activates the sewing machine needle and moves the carriage about the table to sew the top/side edge. The mattress is turned over and the operation is repeated to sew the bottom/side edge.

Known tape edge machines, such as, for example, the 72SNM & 100SNM made by the James Cash Machine Company, Inc. and the NR-E made by Fanghanel have knee pads which the operator can engage to stop sewing and stop the carriage assembly movement about the table. The knee pads are mechanically linked to a braking/clutch idling system and, for example, take about 7 pounds(3.2 kilgorams) of operator pressure to engage. It is also known to employ a small air compressor to provide sewing needle cooling.

SUMMARY OF THE INVENTION

The present invention is for a compressed air operated ergonomic system used with a tape edge machine carriage employed in mattress manufacturing. The operator's arm, leg, knee, or foot can be used to stop the sewing operation and stop the carriage from moving around the table. The compressed air system can also provide an operator air source, engage the gear mechanisms which permit the carriage to move around the table, provide needle cooling, and permit the sewing machine presser foot to be raised.

Finally, the present invention comprises a carriage assembly used with a tape edge machine, the carriage assembly comprising: means for moving the carriage assembly around the tape edge machine; a sewing machine having a sewing needle, the sewing machine attached to the carriage assembly; means for operating the sewing machine needle; an air compressor producing compressed air; means for braking the operating means; means for idling the moving means; and, at least one air switch assembly, the air switch assembly having an input connected to the compressor to receive compressed air and an output connected to an operable air cylinder, the air switch assembly having means for activating the air switch assembly to provide compressed air to the operable air cylinder thereby activating the braking means and the idling means, the air switch assembly having means for deactivating the air switch assembly to not provide compressed air to the operable air cylinder thereby deactivating the braking means and the idling means.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 2:
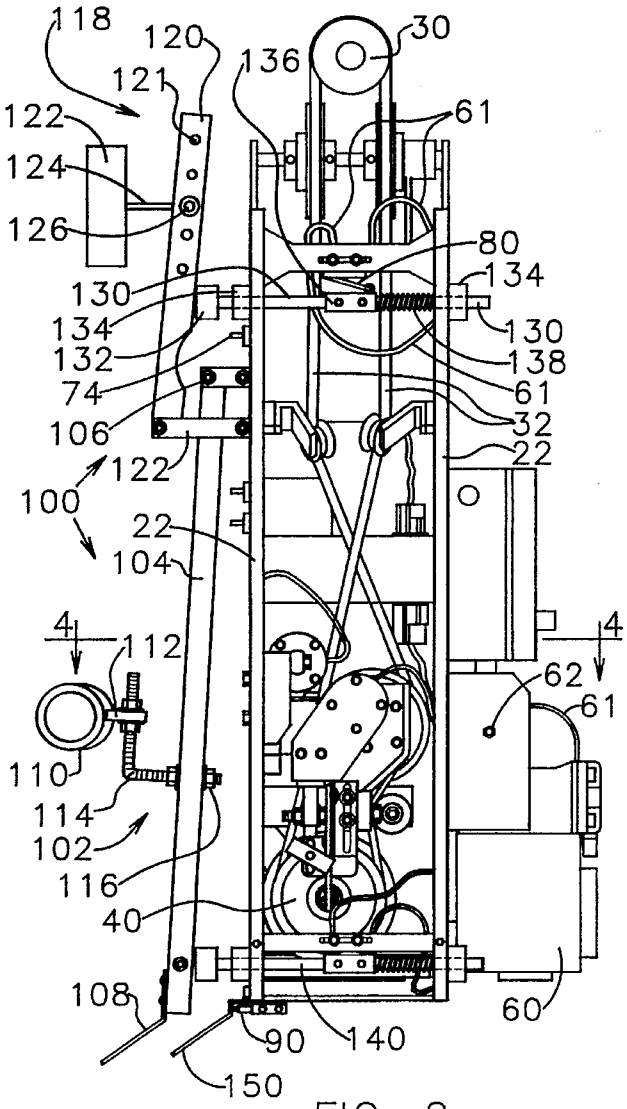
FIG. 2 shows a rear view of the carriage assembly of FIG. 1, the rear cover panel being removed.

With reference to FIGS. 1–4, a portion 10 of the tape edge machine which supports the carriage assembly 20 is shown. As was mentioned in the background, a table assembly holds a mattress for sewing. The table assembly has a top 12 and a bottom 14 guide track therearound. Carriage assembly 20 is supported by the table assembly at the top guide track 12. The carriage assembly has a mechanical drive gear assembly which can engage the top guide track 12 and move the carriage assembly around the table to fully encircle the mattress to be sewn. As shown the drive gear assembly includes a gear driven roller 24 which engages track 12. The carriage assembly 20 has a bottom roller assembly 26 which rolls along the bottom guide track 14 for carriage stability as the carriage assembly 20 moves around the table. The carriage assembly 20 contains the sewing machine used to sew the mattress edges. Only the sewing machine head pulley 30 and round headless head drive belt 32 are shown in FIG. 2. Belt 32 drives pulley 30 which serves as a means for operating the sewing machine needle. The carriage assembly has a housing 22. Housing 22 also includes a rear panel removed from the rear view of FIG. 2 to show the insides of the carriage assembly.

Figure 1:
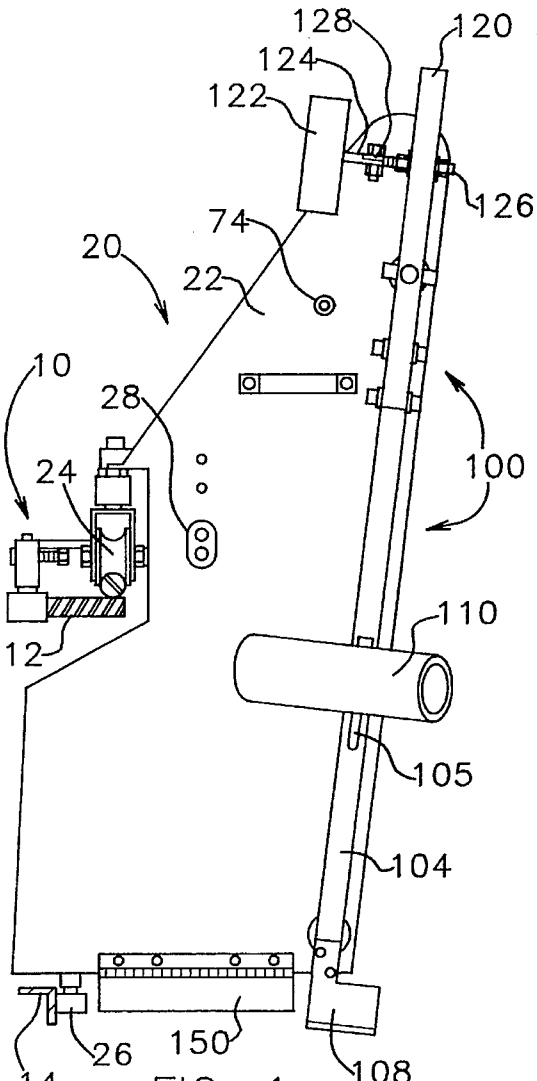
FIG. 1 shows a front side view of the carriage assembly of the tape edge machine of the instant invention, the side being the side the operator faces when operating the tape edge machine.

The carriage assembly operator side of FIG. 1 includes an on/off switch 28 which the operator turns on to activate a drive motor and an air compressor 60. A separate air compressor on/off toggle switch 61 is provided in case the operator wishes to only operate the air compressor 60. The system employing the air compressor 60 will be explained in detail hereinafter.

The drive motor drives a clutch assembly 40. Clutch assembly 40 has two separable halves with a central idler pulley. Carriage assembly 20 also contains a double pulley 42, clutch assembly 40 and double pulley 42 being connected by a "V" drive belt 44. Double pulley 42 drives sewing head pulley belt 32. Double pulley 42 is mechanically linked to the mechanical drive gear assembly which can, if activated, engage the top guide track 12 and move the carriage assembly 20 around the table.

With the tape edge machine engaged in a sewing operation, the carriage assembly 20 on/off switch 28 is "on"; the mechanical drive gear assembly is activated (by turning toggle 74 on, explained hereinafter); and the drive motor causes the clutch assembly 40 to rotate, causing the V belt 44 to rotate, causing the pulley 42 to rotate, causing the carriage assembly 20 to move around the table and causing belt 32 to rotate and thereby cause the sewing machine needle to sew.

The operator has the ability to stop the movement of the carriage assembly 20 around the table and stop the needle from sewing. This is accomplished, in part, by activating a brake 50 to press against double pulley 42 and stop the pulley 42 from rotating and thereby stopping the carriage assembly 20 from moving and stopping belt 32 from rotating. Activation of the brake 50 is explained hereinafter. Brake 50 is connected to a brake/clutch connecting rod 52. Rod 52, at the clutch 40 end, is connected to a clutch idler arm 54. Rod 52 pivots about a brake pivot 56. Brake 50 and clutch idler arm 54 function like a see-saw about pivot 56. When brake 50 is activated and moves to engage pulley 42 like a disk brake, rod 52 pivots about pivot 56 causing clutch idler arm 54 to pull the two clutch halves of clutch 40 apart. The "togetherness" of the clutch halves being driven by the drive motor was causing V belt 44 to rotate. Pulling the clutch halves apart permits belt 44 to engage the clutch 40 center idler pulley and no longer be driven. The engagement of brake 50 and pulley 42 stops pulley 42 and thereby stops the movement of belt 44 on the center idler pulley.

In known tape edge machines, brake 50 was activated by pressing on a knee pad mechanically linked to brake 50. The system of the present invention employs a compressed air system and uses an ergonomic assembly 100, explained in more detail hereinafter, to permit the tape edge machine operator to use his foot, knee or leg, or forearm to activate the brake 50.

Figure 3:
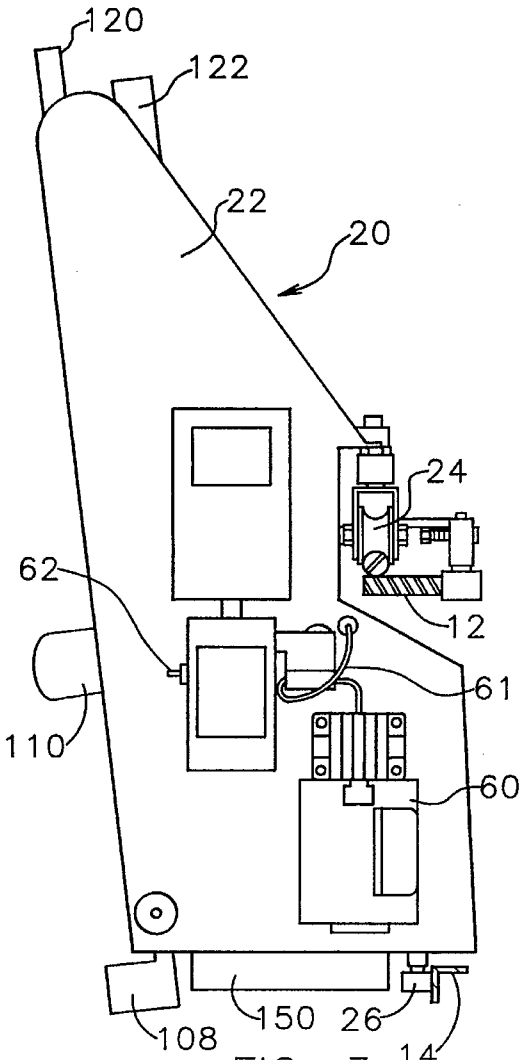
FIG. 3 shows a back side view of the carriage assembly of FIG. 1.
Figure 4:
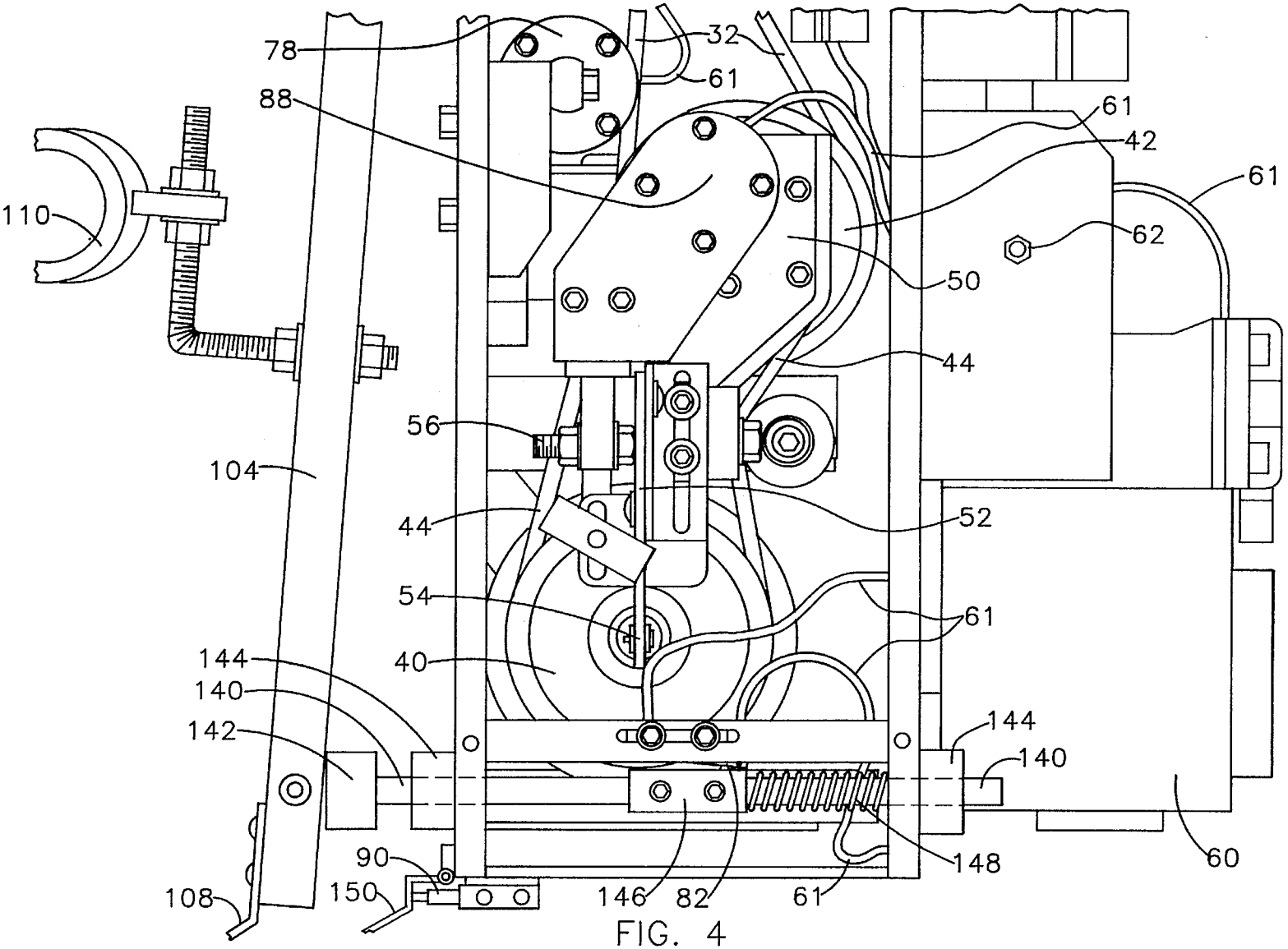
FIG. 4 shows an exploded view of the lower rear portion of the carriage assembly of FIG. 2, along the lines 4—4; and, FIG. 5 shows a schematic flow diagram of the compressed air system employed with the carriage assembly of FIGS. 1–4.
Figure 5:
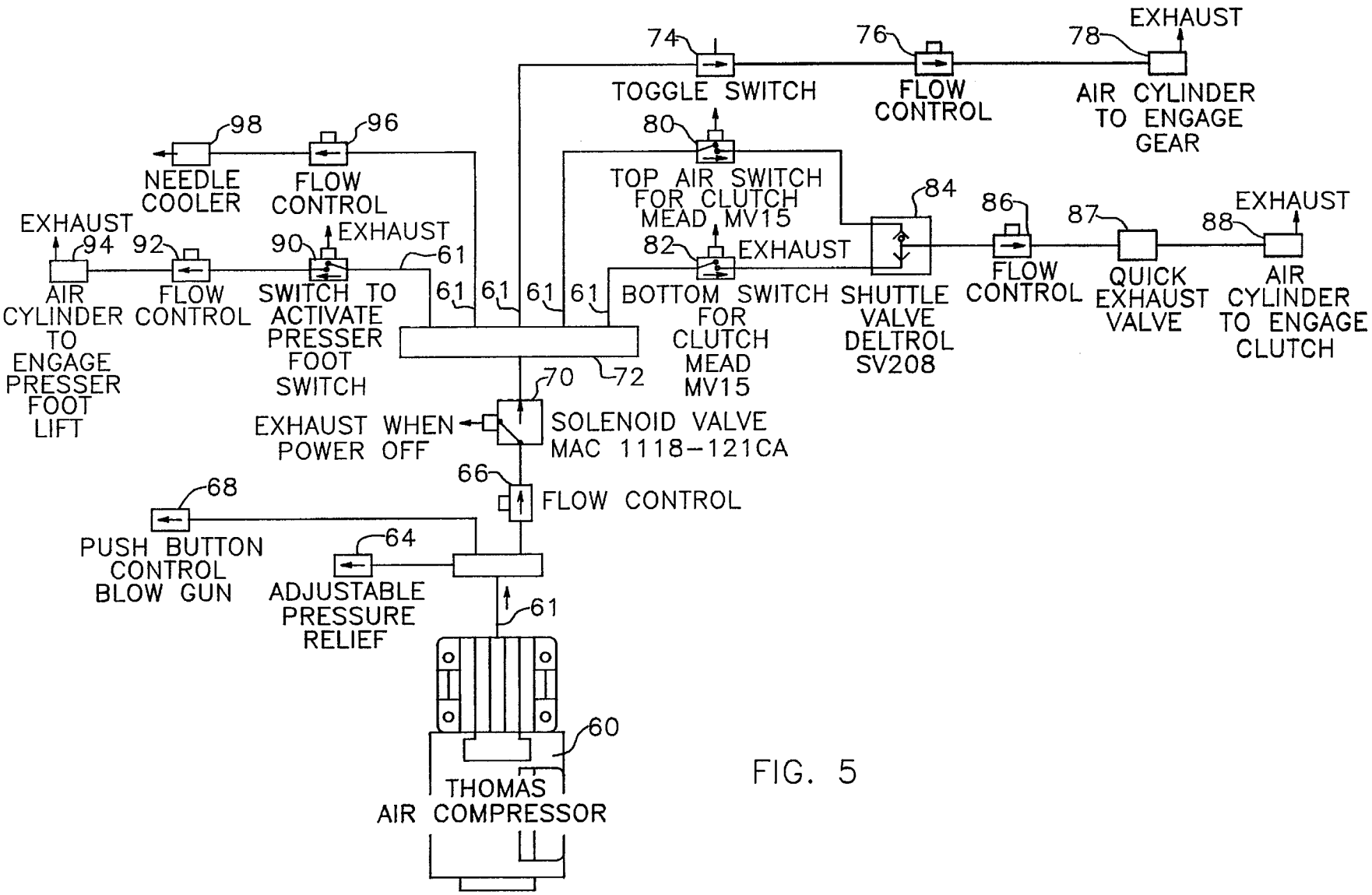

FIGS. 2–4 show many compressed air lines 61 and some components used, such as pancake air cylinders 78 and 88 and air switches 80 and 82. However, the air line 61 connectivity is incomplete and not all components are shown in FIGS. 2–4. Therefore, reference is made to FIG. 5 to explain the five functions performable by compressed air in the preferred embodiment of the instant invention. Compressed air from compressor 60, activatable by on/off toggle 62 to only operate the compressor or activatable by on/off switch 28 to operate the tape edge machine, passes through lines 61, as limited by the hereinafter components, to: 1) permit the operator to "blow-off" the tape edge machine; 2) blow air onto the needle for cooling; 3) permit the operator to activate a pancake air cylinder to engage the gear assembly functioning to move the carriage assembly around the tape edge machine; 4) permit the operator activate brake 50; and, 5) permit the operator to lift the sewing machine presser foot.

With compressor 60 turned on, compressed air is provided. Pressure is adjustable by valve 64. One compressed air line is provided to a push button control on a blow gun 68. The blow gun is used by the operator to "blow-off" the tape edge machine. Compressed air is provided to a flow control 66 and to a solenoid valve 70. From solenoid 70 compressed air is provided to five "circuits", shown exiting a manifold 72, for example. Many "plumbing" techniques can be employed to provide connectivity of the compressed air to the five circuits, and manifold 72 is shown for simplicity.

Compressed air is provided through one line 61 to previously described toggle switch 74, through flow control valve 76 to a pancake air cylinder 78. The operator must turn the toggle switch 74 on to be able to engage the system which drives the carriage assembly 20 around the table. Toggle 74 can be left in the "on" position, so that every time on/off switch 28 is activated the carriage assembly 20 can be driven by the already described drive motor.

Compressed air is provided through two lines 61 to a top air switch 80 and a bottom air switch 82. Ergonomic assembly 100 used to activate brake 50 has a lower ergonomic assembly 102 and an upper ergonomic assembly 118, explained hereinafter. Upper assembly 118 is used by the operator to activate switch 80 and lower assembly 102 is used to activate switch 82. While a single switch could be employed, the configuration shown is preferred, as it lets the operator use his foot, leg or knee, or forearm to activate the brake 50. Switches 80 and 82 can be, for example, Mead MV15 air switches.

The compressed air output lines from switches 80 and 82 connect to a shuttle valve 84, for example, a Deltrol SV20B valve. Valve 84 permits either switch 80 or 82 to activate brake 50 by providing compressed air to flow control 86 through a quick exhaust valve 87 to pancake air cylinder 88. Pancake air cylinder 88, when activated, causes the brake 50 to contact pulley 42 and separate the halves of clutch 40, to stop the carriage movement and stop the needle sewing, as was previously described. When activated switch 80 or 82 is deactivated, quick exhaust valve 87 quickly dumps the compressed air provided to cylinder 88 thereby quickly releasing brake 50 and engaging clutch 40 by letting the clutch halves come toward each other and drive V belt 44.

Compressed air is provided through one line 61 to flow control 96 to a needle cooler 98. Finally, compressed air is provided through one additional line 61 to a switch 90. A foot pedal 150 can be used by the operator to activate switch 90, thereby providing compressed air to a flow control 92 and to an air cylinder 94 which lifts the sewing machine presser foot from the mattress material being sewn.

Ergonomic system 100, used to activate/deactivate switches 80 or 82 is now detailed. As it is desired that an operator be able to use his foot, knee or leg, or forearm to activate brake 50, the preferred embodiment shown system 100 having a lower assembly 102 and an upper assembly 118. While a single system arm running approximately the length of carriage assembly 20 could be employed, a single arm fulcrum would require move operator force to operate the closer the operator is to the fulcrum point. Therefore, the preferred embodiment employs upper switch 80 and lower switch 82 and respective systems 118 and 102 to activate them.

Lower ergonomic assembly 102 has an arm 104 extending approximately downward from lower arm mount 106 which is connected to carriage housing 22. Arm 104 has an adjustment slot 105 therethrough. Connected toward the bottom of arm 104 is an operator foot pedal 108. A knee bar 110, shown as a cylindrical shaped roll has a swivel mounting assembly 112 connected thereto. Mount 112 is connected to the vertical portion of an "L" bar 114. By mount 116, the vertical portion of L bar 114 is connected to arm 104 in slot 105. Knee bar 110 can be set as desired by the unique operator using mount 112 to swivel bar 110 and to raise or lower it on bar 114. Bar 114 can also be raised or lowered in slot 105.

Upper ergonomic assembly 118 has an arm 120 extending approximately upward from upper arm mount 122 which is connected to carriage housing 22. Arm 120 has a plurality of adjustment bores 121 therethrough. An arm bar 122, shown as a cylindrical shaped roll has a rod 124 connected thereto. A connector bar 126 is connected into an operator desired bore 121. Bar 122 and 126 can be joined by swivel connector 128, which permits the operator to place arm bar 122 in a desired orientation.

A rod 130 having a head portion 132, passes horizontally through carriage assembly 20 and is supported by a pair of supports 134 on opposed sides of housing 22. A switch activator 136 is attached to rod 130. A spring 138 surrounds rod 130 between switch activator 136 and the carriage assembly back side housing. Likewise, a rod 140 having a head portion 142, passes horizontally through carriage assembly 20 and is supported by a pair of supports 144 on opposed sides of housing 22. A switch activator 146 is attached to rod 140. A spring 148 surrounds rod 140 between switch activator 146 and the carriage assembly back side housing. Switch activator 136 is used to activate/deactivate switch 80 and switch activator 146 is used to activate/deactivate switch 82.

To use his forearm to stop the carriage moving and to stop sewing, the operator presses his forearm to arm bar 122. This pushes arm 120 toward carriage assembly 20, thereby pushing on the head 132 of rod 130 and pushing rod 130 away from the operator's side of the carriage assembly 20. This causes switch activator 136 to activate switch 80 and thereby activate brake 50. The movement of rod 130 compresses spring 138. Spring 138 determines how much pressure the operator must exert with his forearm to activate brake 50. As was previously explained, with mechanically operated brakes, about 7 pounds (3.2 kilograms) of pressure is required. With the compressed air system, if desired, a pound (0.45 kilograms) or less of pressure can activate the brake 50. When the operator removes his forearm from arm bar 122, the spring 138 forces the head 132 toward the operator, turning off switch 80 and causing the carriage assembly 20 to start moving around the table and causing the needle to start sewing.

To use his foot or knee or leg to stop the carriage moving and to stop sewing, the operator either presses his foot against foot pedal 108 or presses his leg or knee against bar 110. This pushes arm 104 toward carriage assembly 20, thereby pushing on the head 142 of rod 140 and pushing rod 140 away from the operator's side of the carriage assembly 20. This causes switch activator 146 to activate switch 82 and thereby activate brake 50. The movement of rod 140 compresses spring 148. Spring 148 determines how much pressure the operator must exert with his foot, knee or leg to activate brake 50. Springs 138 and 148 can be sized differently to require different pressures to operate respective switches 80 and 82, if desired. When the operator removes his foot, or knee or leg from pedal 108 or bar 110, respectively, the spring 148 forces the head 142 toward the operator, turning off switch 82 and causing the carriage assembly 20 to start moving around the table and causing the needle to start sewing.

The shape of switch activators 136 and 146 are such that respective switches 80 and 82 are not instantaneously turned on. Looking to FIG. 4, the top portion of switch activator 146 is shown having an upward slope from the right (spring 148) side to the left side. This permits the shown activation arm of switch 82 to be eased upward, thereby making the activation of switch 82 non-instantaneous. This is similar to turning on a screw valve on a water faucet in that the water starts flowing slowly and as the valve is opened further, the water flows faster.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A carriage assembly used with a tape edge machine, said carriage assembly comprising:

(a) means for moving Said carriage assembly around said tape edge machine;

(b) a sewing machine having a sewing needle, said sewing machine attached to said carriage assembly;

(c) means for operating said sewing machine needle;

(d) an air compressor, said air compressor producing compressed air;

(e) means for braking said operating means;

(f) means for idling said moving means; and, (g) at least a first air switch assembly and a second air switch assembly, where each of said first and said second air switch assemblies has an air switch, said air switch having an input connected to said compressor to receive said compressed air and an output connected to an operable air cylinder, where each of said first and said second air switch assemblies has means for activating said air switch to provide said compressed air to said operable air cylinder thereby activating said braking means and said idling means, where each of said first and said second air switch assemblies has means for deactivating said air switch to not provide said compressed air to said operable air cylinder thereby deactivating said braking means and said idling means; where said activating means of said first air switch assembly is operable by a tape edge machine operator's knee, leg, or foot and where said activating means of said second air switch assembly is operable by said tape edge machine operator's arm.

2. A carriage assembly used with a tape edge machine, said carriage assembly comprising:

(a) means for moving said carriage assembly around said tape edge machine;

(b) a sewing machine having a sewing needle, said sewing machine attached to said carriage assembly;

(c) means for operating said sewing machine needle;

(d) an air compressor, said air compressor producing compressed air;

(e) means for braking said operating means;

(f) means for idling said moving means; and, (g) at least one air switch assembly, said air switch assembly having an air switch, said air switch having an input connected to said compressor to receive said compressed air and an output connected to an operable air cylinder, said air switch assembly having means for activating said air switch to provide said compressed air to said operable air cylinder thereby activating said braking means and said idling means, said air switch assembly having means for deactivating said air switch to not provide said compressed air to said operable air cylinder thereby deactivating said braking means and said idling means, where:

(1) said means for activating said air switch to provide said compressed air to said operable air cylinder thereby activating said braking means and said idling means further comprises:

(i) a lever arm, said arm pivotally mounted to said carriage assembly, (ii) a push bar extending through said carriage assembly and slidably retained thereby, said push bar having a first and a second end, said ends extending from said carriage assembly, said first end of said push bar touching said lever arm, (iii) a switch activator attached to said push bar, (iv) where a tape edge machine operator pushes on said lever arm, thereby pushing on said push bar causing said switch activator to activate said air switch; and, (2) said means for deactivating said air switch to not provide said compressed air to said operable air cylinder thereby deactivating said braking means and said idling means further comprises:

(i) a spring, said spring surrounding said push bar between said switch activator and said carriage assembly toward said second end of said push bar, (ii) a quick exhaust air valve between said air switch and said operable air cylinder, (iii) where, when said tape edge machine operator pushes on said lever arm, thereby pushing on said push bar causing said switch activator to activate said air switch, said spring compresses, and where, when said tape edge machine operator quits pushing on said lever arm, said spring causes said push bar to move to deactivate said air switch and said quick exhaust air valve quickly relieves said compressed air from said air cylinder.

3. The carriage assembly of claim 2, said lever arm including an arm bar, where said tape edge machine operator pushes on said arm bar with his forearm to activate said air switch.

4. The carriage assembly of claim 2, said lever arm including a foot pedal, where said tape edge machine operator pushes on said foot pedal with his foot to activate said air switch.

5. The carriage assembly of claim 4, said lever arm including a knee bar, where said tape edge machine operator pushes on said knee bar with his knee or leg to activate said air switch.

6. A carriage assembly used with a tape edge machine, said carriage assembly comprising:

(a) means for moving said carriage assembly around said tape edge machine;

(b) a sewing machine having a sewing needle, said sewing machine attached to said carriage assembly;

(c) means for operating said sewing machine needle;

(d) an air compressor, said air compressor producing compressed air;

(e) means for braking said operating means;

(f) means for idling said moving means;

(g) at least one air switch assembly, said air switch assembly having an air switch, said air switch having an input connected to said compressor to receive said compressed air and an output connected to an operable air cylinder, said air switch assembly having air switch activating means to provide said compressed air to said operable air cylinder thereby activating said braking means and said idling means, said air switch assembly having means for deactivating said air switch to not provide said compressed air to said operable air cylinder thereby deactivating said braking means and said idling means; and, (h) means for activating said carriage assembly moving means; where said means for activating said carriage assembly moving means includes an on/off air toggle switch and an operable air cylinder, said air toggle switch having an input connected to said compressor to receive said compressed air and an output connected to said operable air cylinder, where, when said air toggle switch is turned on, said compressed air is provided to said air cylinder to activate said carriage assembly moving means and where, when said air toggle switch is turned off, said compressed air is not provided to said air cylinder to deactivate said carriage assembly moving means.

7. A carriage assembly used with a tape edge machine, said carriage assembly comprising:

(a) means for moving said carriage assembly around said tape edge machine;

(b) a sewing machine having a sewing needle, said sewing machine attached to said carriage assembly;

(c) means for operating said sewing machine needle;

(d) an air compressor, said air compressor producing compressed air;

(e) means for braking said operating means;

(f) means for idling said moving means;

(g) at least one air switch assembly, said air switch assembly having an air switch, said air switch having an input connected to said compressor to receive said compressed air and an output connected to an operable air cylinder, said air switch assembly having air switch activating means to provide said compressed air to said operable air cylinder thereby activating said braking means and said idling means, said air switch assembly having means for deactivating said air switch to not provide said compressed air to said operable air cylinder thereby deactivating said braking means and said idling means; and, (h) means for lifting a presser foot of said sewing machine, said lifting means including an air switch, a foot pedal, and an operable air cylinder; said air switch having an input connected to said compressor to receive said compressed air and an output connected to said operable air cylinder, where, when said foot pedal is pressed by a tape edge machine operator, said air switch is turned on and said compressed air is provided to said air cylinder to lift said presser foot and where, when said foot pedal is released, said air switch is turned off and said compressed air is not provided to said air cylinder to not lift said presser foot.

8. An air switch assembly employed with a carriage assembly of a tape edge machine, said air switch assembly comprising:

(a) an air switch, said air switch having an input connected to an air compressor producing compressed air, said input receiving said compressed air, said air switch having an output connected to an operable air cylinder;

(b) means for activating said air switch to provide said compressed air to said operable air cylinder; where said means for activating said air switch to provide said compressed air to said operable air cylinder further comprises:

(i) a lever arm, said arm pivotally mounted to said carriage assembly, (ii) a push bar extending through said carriage assembly and slidably retained thereby, said push bar having a first and a second end, said ends extending from said carriage assembly, said first end of said push bar touching said lever arm, (iii) a switch activator attached to said push bar, (iv) where a tape edge machine operator pushes on said lever arm, thereby pushing on said push bar causing said switch activator to activate said air switch; and, (b) means for deactivating said air switch to not provide said compressed air to said operable air cylinder; where said means for deactivating said air switch to not provide said compressed air to said operable air cylinder further comprises:

(i) a spring, said spring surrounding said push bar between said switch activator and said carriage assembly toward said second end of said push bar, (ii) a quick exhaust air valve between said air switch and said operable air cylinder, (iii) where, when said tape edge machine operator pushes on said lever arm, thereby pushing on said push bar causing said switch activator to activate said air switch, said spring compresses, and where, when said tape edge machine operator quits pushing on said lever arm, said spring causes said push bar to move to deactivate said air switch and said quick exhaust air valve quickly relieves said compressed air from said air cylinder.

9. The air switch assembly of claim 8, said lever arm including an arm bar, where said tape edge machine operator pushes on said arm bar with his forearm to activate said air switch.

10. The air switch assembly of claim 8, said lever arm including a foot pedal, where said tape edge machine operator pushes on said foot pedal with his foot to activate said air switch.

11. The air switch assembly of claim 10, said lever arm including a knee bar, where said tape edge machine operator pushes on said knee bar with his knee or leg to activate said air switch.

12. A multiple air switch assembly employed with a carriage assembly of a tape edge machine, said multiple air switch assembly comprising:

(a) a first air switch, said first air switch having an input connected to an air compressor producing compressed air, said input receiving said compressed air, said first air switch having an output connected to a first input of a shuttle valve;

(b) a second air switch, said second air switch having an input connected to said air compressor producing compressed air, said input receiving said compressed air, said second air switch having an output connected to a second input of said shuttle valve;

(c) a quick exhaust valve having an input connected to an output of said shuttle valve;

(d) an air cylinder having an input connected to an output of said quick exhaust valve;

(e) means for activating said first air switch to provide said compressed air through said shuttle valve and said quick exhaust valve to said operable air cylinder thereby activating means for braking and means for idling;

(f) means for activating said second air switch to provide said compressed air through said shuttle valve and said quick exhaust valve to said operable air cylinder thereby activating means for braking and means for idling;

(g) means for deactivating said first air switch and means for deactivating said second air switch to not provide said compressed air to said operable air cylinder thereby deactivating said means for braking and said means for idling, said quick exhaust air valve quickly relieving said compressed air from said air cylinder.

13. The multiple air switch assembly of claim 12, where:

(a) said means for activating said first air switch to provide said compressed air to said operable air cylinder thereby activating said braking means and said idling means further comprises:

(i) a first lever arm, said arm pivotally mounted to said carriage assembly, (ii) a first push bar extending through said carriage assembly and slidably retained thereby, said push bar having a first and a second end, said ends extending from said carriage assembly, said first end of said push bar touching said first lever arm, (iii) a first switch activator attached to said first push bar, (iv) where a tape edge machine operator pushes on said first lever arm, thereby pushing on said first push bar causing said first switch activator to activate said first air switch;

(b) said means for deactivating said first air switch further comprises:

(i) a first spring, said first spring surrounding said first push bar between said first switch activator and said carriage assembly toward said second end of said first push bar, (ii) where, when said tape edge machine operator pushes on said first lever arm, thereby pushing on said first push bar causing said first switch activator to activate said first air switch, said spring compresses, and where, when said tape edge machine operator quits pushing on said first lever arm, said spring causes said first push bar to move to deactivate said first air switch;

(c) said means for activating said second air switch to provide said compressed air to said operable air cylinder thereby activating said braking means and said idling means further comprises:

(i) a second lever arm, said arm pivotally mounted to said carriage assembly, (ii) a second push bar extending through said carriage assembly and slidably retained thereby, said push bar having a first and a second end, said ends extending from said carriage assembly, said first end of said push bar touching said second lever arm, (iii) a second switch activator attached to said second push bar, (iv) where said tape edge machine operator pushes on said second lever arm, thereby pushing on said second push bar causing said second switch activator to activate said second air switch; and, (d) said means for deactivating said second air switch further comprises:

(i) a second spring, said second spring surrounding said second push bar between said second switch activator and said carriage assembly toward said second end of said second push bar, (ii) where, when said tape edge machine operator pushes on said second lever arm, thereby pushing on said second push bar causing said second switch activator to activate said second air switch, said spring compresses, and where, when said tape edge machine operator quits pushing on said second lever arm, said spring causes said second push bar to move to deactivate said second air switch.

14. The multiple air switch assembly of claim 13, where:

(a) said first lever arm includes an arm bar, where said tape edge machine operator pushes on said arm bar with his forearm to activate said first air switch;

(b) said second lever am includes a foot pedal, where said tape edge machine operator pushes on said foot pedal with his foot to activate said second air switch; and, (c) said second lever arm includes a knee bar, where said tape edge machine operator pushes on said knee bar with his knee or leg to activate said second air switch.

* * * * *

UNITED STATES PATENT AND TRADEMARK OFFICE

CERTIFICATE OF CORRECTION

PATENT NO. : 5,497,718

DATED : March 12, 1996

INVENTOR(S) : David R. Cash

It is certified that error appears in the above-identified patent and that said Letters Patent is hereby corrected as shown below:

Claim 14, Column 11, line 5, change "am" to --arm--

Signed and Sealed this

Tenth Day of November 1998

*Attest:*

*Attesting Officer*

Bruce Lehman

BRUCE LEHMAN

*Commissioner of Patents and Trademarks*